US009430914B2

(12) United States Patent
Delekta

(10) Patent No.: US 9,430,914 B2
(45) Date of Patent: Aug. 30, 2016

(54) GAMING MACHINE AND METHODS OF ALLOWING A PLAYER TO PLAY GAMING MACHINES HAVING SELECTABLE REEL STRIPS

(71) Applicant: Konami Gaming, Inc., Las Vegas, NV (US)

(72) Inventor: Scott Delekta, Las Vegas, NV (US)

(73) Assignee: KONAMI GAMING, INC., Las Vegas, NV (US)

( * ) Notice: Subject to any disclaimer, the term of this patent is extended or adjusted under 35 U.S.C. 154(b) by 0 days.

(21) Appl. No.: 14/092,646

(22) Filed: Nov. 27, 2013

(65) Prior Publication Data

US 2014/0179402 A1 Jun. 26, 2014

(30) Foreign Application Priority Data

Dec. 21, 2012 (AU) ..... 2012271903

(51) Int. Cl.

| | |
|---|---|
| ***A63F 9/24*** | (2006.01) |
| ***G07F 17/34*** | (2006.01) |
| ***G07F 17/32*** | (2006.01) |

(52) U.S. Cl.

CPC ..... *G07F 17/34* (2013.01); *G07F 17/3213* (2013.01); *G07F 17/3244* (2013.01); *G07F 17/3262* (2013.01)

(58) Field of Classification Search

CPC ..... G07F 17/32; G07F 17/3202; G07F 17/3213; G07F 17/3244; G07F 17/326

USPC ..... 463/16, 20, 29, 42; 273/138.1, 138.2, 273/143 R

See application file for complete search history.

(56) References Cited

U.S. PATENT DOCUMENTS

| | | | | |
|---|---|---|---|---|
| 5,102,137 | A * | 4/1992 | Ekiert | 273/143 R |
| 7,001,274 | B2 * | 2/2006 | Baerlocher et al. | 463/20 |
| 7,108,602 | B2 | 9/2006 | Daly | |
| 7,927,204 | B2 | 4/2011 | DeBrabander, Jr. et al. | |
| 8,096,869 | B2 | 1/2012 | Yoshimi | |
| 8,096,877 | B2 | 1/2012 | Hoffman | |
| 8,105,145 | B2 | 1/2012 | Jaffe | |
| 8,137,179 | B2 | 3/2012 | Jensen et al. | |
| 8,226,468 | B2 | 7/2012 | Hoffman et al. | |

(Continued)

OTHER PUBLICATIONS

Patent Examination Report No. 1 (AU 2014202516)—Date of Issue: Jun. 10, 2014.

(Continued)

*Primary Examiner* — Jay Liddle
*Assistant Examiner* — Ryan Hsu
(74) *Attorney, Agent, or Firm* — Howard & Howard Attorneys PLLC

(57) ABSTRACT

A method of allowing a player to play a gaming machine is described herein. The method includes displaying a game including at least one reel and a plurality of reel strips for display with the at least one reel. Each reel strip includes a plurality of normal symbol positions and a plurality of special symbol positions. The plurality of reel strips includes a first reel strip having a first number of special symbol positions and a second reel strip having a second number of special symbol positions that is different than the first number of special symbol positions. The method also includes randomly generating an outcome of the game and displaying the game outcome on the display device. One of the first reel strip and the second reel strip is randomly selected for display with the at least one reel.

30 Claims, 9 Drawing Sheets

(56) References Cited

U.S. PATENT DOCUMENTS

| | | | | |
|---|---|---|---|---|
| 8,235,796 | B2 * | 8/2012 | Nakamura | G07F 17/3213 273/143 R |
| 2005/0071023 | A1 * | 3/2005 | Gilliland et al. | 700/91 |
| 2005/0159208 | A1 | 7/2005 | Pacey | |
| 2005/0159211 | A1 * | 7/2005 | Englman | 463/25 |
| 2005/0239539 | A1 | 10/2005 | Inamura | |
| 2006/0030390 | A1 * | 2/2006 | Okada | G07F 17/32 463/16 |
| 2006/0058097 | A1 | 3/2006 | Berman et al. | |
| 2007/0105611 | A1 | 5/2007 | O'Halloran | |
| 2008/0108411 | A1 | 5/2008 | Jensen et al. | |
| 2008/0132321 | A1 * | 6/2008 | Pau | 463/20 |
| 2009/0124347 | A1 | 5/2009 | Rodgers et al. | |
| 2009/0163268 | A1 | 6/2009 | Lyons et al. | |
| 2010/0124972 | A1 | 5/2010 | Rodgers et al. | |
| 2012/0083327 | A1 | 4/2012 | Zobel et al. | |
| 2012/0094740 | A1 | 4/2012 | Yoshimi | |
| 2012/0157181 | A1 | 6/2012 | Jensen et al. | |
| 2012/0172106 | A1 * | 7/2012 | Caputo et al. | 463/20 |

OTHER PUBLICATIONS

Patent Examination Report No. 1—Date of Issue Nov. 15, 2013.

Patent Examination Report No. 2 (AU 2014202516); Date of Issue: Dec. 8, 2014.

* cited by examiner

GAMING MACHINE AND METHODS OF ALLOWING A PLAYER TO PLAY GAMING MACHINES HAVING SELECTABLE REEL STRIPS

CROSS-REFERENCE TO RELATED APPLICATION

This application claims priority to Australian Patent Application No. 2012271903, filed Dec. 21, 2012, the disclosure of which is hereby incorporated by reference in its entirety.

TECHNICAL FIELD

The subject matter disclosed herein relates generally to gaming machines and more particularly, to an apparatus and method for allowing players to play gaming machines having selectable reel strips.

BACKGROUND OF THE INVENTION

Gaming machines, such as slot machines, are a cornerstone of the gaming industry. At least some known gaming machines include a video display device to display a reel game that includes a plurality of reels, wherein each reel includes a plurality of symbols. During game play, the gaming machine accepts a wager from a player, the player selects one or more paylines, the gaming machine spins the reels, and sequentially stops each reel to display the generated combination of symbols on the reels. The gaming machine then awards the player an award based on the combination of symbols orientated along the selected payline.

At least some known gaming machines display reels having a plurality of special symbols displayed within the reel. Known reels include a predefined number of special symbols displayed in each reel. Over time, during game play, the player may become aware of the number of special symbols that are displayed in each reel and may become frustrated because the number of special symbols within each reel remains constant for each game play. Accordingly, new features are necessary to appeal to player interest and enhance excitement in order to entice longer play and increased profitability. The present invention is directed to satisfying these needs.

SUMMARY OF THE INVENTION

In one aspect of the present invention, a method of allowing a player to play a gaming machine is provided. The method includes displaying, on a display device, a game including at least one reel and a plurality of reel strips for display on the at least one reel. Each reel strip of the plurality of reel strips includes a plurality of normal symbol positions and a plurality of special symbol positions. The plurality of reel strips includes a first reel strip having a first number of special symbol positions and a second reel strip having a second number of special symbol positions that is different than the first number of special symbol positions. The method also includes randomly generating an outcome of the game and displaying the game outcome on the display device. One of the first reel strip and the second reel strip of the plurality of reel strips is randomly selected for display on the at least one reel, and the at least one reel is spun and stopped to display the generated game outcome including the selected one of the first and second reel strips.

In another aspect of the present invention, a gaming machine is provided. The gaming machine includes a display device, a user input device configured to generate a signal indicative of a player's selection input, and a controller coupled to the display device and the user input device for displaying a game on the display device. The game including at least one reel and a plurality of reel strips associated with the at least one reel. Each reel strip of the plurality of reel strips includes a plurality of normal symbol positions and a plurality of special symbol positions. The plurality of reel strips includes a first reel strip having a first number of special symbol positions and a second reel strip having a second number of special symbol positions that is different than the first number of special symbol positions. The controller is configured to randomly generate an outcome of the game and display the game outcome on the display device. The controller also randomly selects one of the first reel strip and the second reel strip of the plurality of reel strips for display on the at least one reel, and spins and stops the at least one reel to display the generated game outcome including the selected one of the first and second reel strips.

In yet another aspect of the present invention, a system is provided. The system includes a plurality of gaming devices and a system controller. Each gaming device includes a user input device for accepting a player's selection input and a display device. The system controller is coupled to each gaming device for displaying a game on at least one gaming device. The game includes at least one reel and a plurality of reel strips associated with the at least one reel. Each reel strip of the plurality of reel strips includes a plurality of normal symbol positions and a plurality of special symbol positions. The plurality of reel strips includes a first reel strip having a first number of special symbol positions and a second reel strip having a second number of special symbol positions that is different than the first number of special symbol positions. The system controller is configured to randomly generate an outcome of the game, randomly select one of the first reel strip and the second reel strip of the plurality of reel strips for display on the at least one reel, and spin and stop the at least one reel to display the generated game outcome including the selected one of the first and second reel strips.

BRIEF DESCRIPTION OF THE DRAWINGS

Other advantages of the present invention will be readily appreciated as the same becomes better understood by reference to the following detailed description when considered in connection with the accompanying drawings wherein.

Corresponding reference characters indicate corresponding parts throughout the drawings.

DETAILED DESCRIPTION OF THE PREFERRED EMBODIMENT

Figure 1:
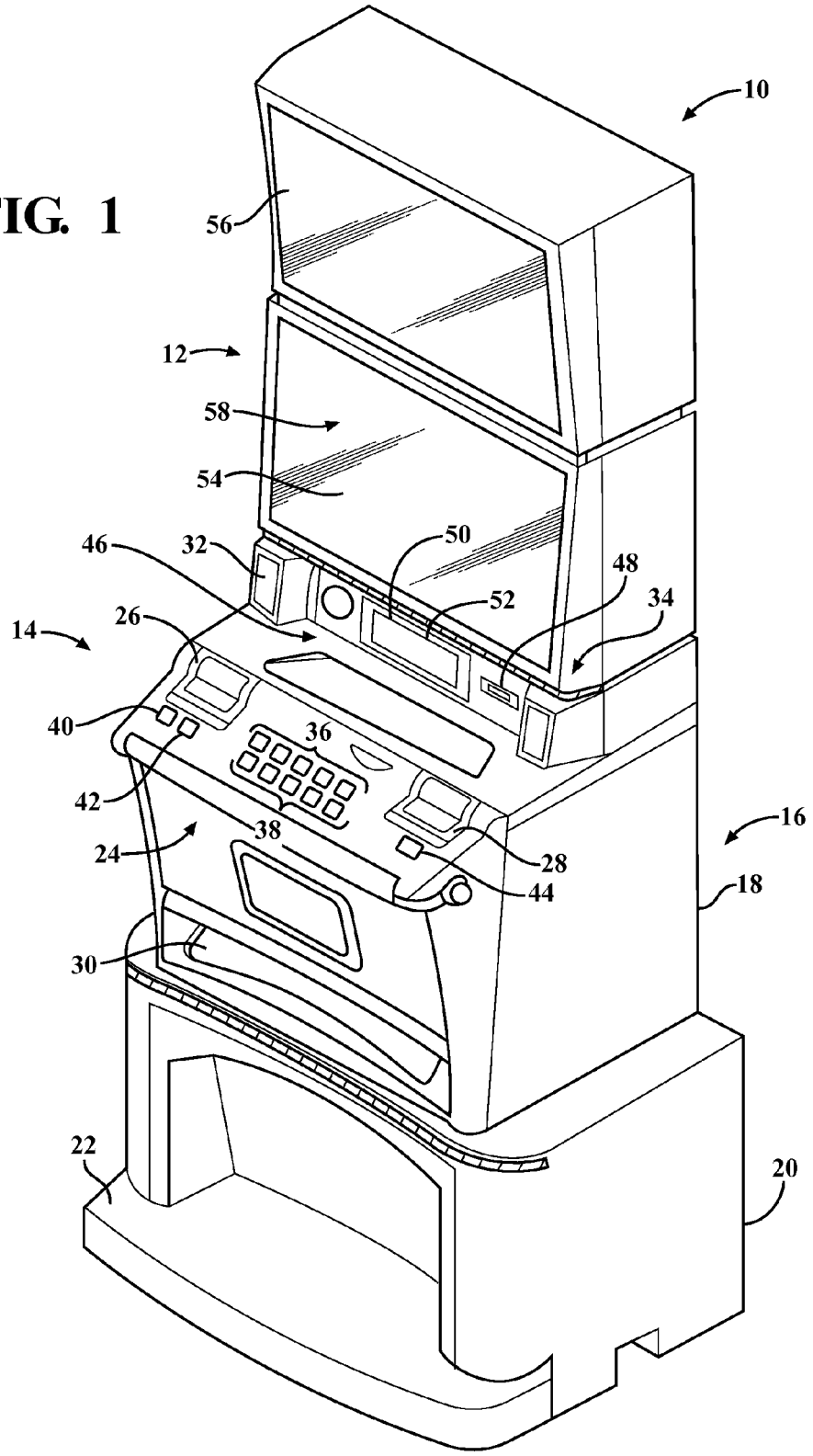
FIG. 1 is a perspective view of an exemplary gaming machine of the present invention.

With reference to the drawings and in operation, the present invention overcomes at least some of the disadvantages of known gaming machines by providing a gaming machine that generates an outcome of a game including a plurality of reels and selectively displays one of a plurality of reel strips with each of the game reels to facilitate increasing a player's expectation of achieving a winning combination in the generated game. More specifically, the gaming machine randomly selects one of a plurality of reels strips being displayed in each of the game reels, wherein each of the plurality of reel strips includes a different number of special symbol positions. In one embodiment of the present invention, the gaming machine may also randomly select a special symbol being displayed in each of the special symbol positions displayed in each of the reels. In one embodiment of the present invention, the special symbol positions may be in "runs" of adjacent positions. Because the number of special symbol positions displayed in each reel indicates, to the player, a probability of achieving a winning outcome, the anticipation of achieving a winning outcome is increased based on the number of special symbol positions displayed in each selected reel strip. By providing a gaming machine that randomly selects one of a plurality of reel strips including a number of special symbol positions for each of the game reels, the player's expectation for achieving a win is increased and the enjoyment of the game is improved. Thus, the amount of time that the game is played by patrons of a gaming establishment is thereby increased.

In general, the gaming machine 10 allows a player to initiate a gaming session to play a plurality of video slot games via the gaming machine 10. The gaming machine 10 displays a game, accepts a wager on the game, generates a game outcome including a plurality of symbols at a plurality of symbol positions, and provides an award to the player if a winning combination is displayed in the generated game outcome. During play of the game, the gaming machine 10 displays at least one reel including a plurality of reel strips associated with the reel. Each reel strip includes a plurality of special symbol positions and a plurality of normal symbol positions. The number of special symbol positions on each of the reel strips is different. The gaming machine 10 randomly selects one reel strip of the plurality of reel strips and displays the selected reel strip on the reel including the number of special symbol positions and the number of normal symbol positions associated with the selected reel strip.

In one embodiment, the gaming machine 10 may also randomly select one or more special symbols being displayed in each special symbol position. In addition, the gaming machine selects a plurality of normal symbols being displayed in each normal symbol position. During game play, the gaming machine 10 spins the reels to display, to the player, the selected reel strips having the associated number of special symbol positions including the selected special symbol and the associated number of normal symbol positions including the plurality of normal symbols, and stops the reels to display the generated outcome to the player. Because the gaming machine 10 displays the reels with a plurality of special symbols, the player's anticipation of a winning outcome is increased, thus increasing the period of time the gaming machine 10 is played by the player.

A selected embodiment of the present invention will now be explained with reference to the drawings. It will be apparent to those skilled in the art from this disclosure that the following description of the embodiment of the present invention is provided for illustration only and not for the purpose of limiting the invention as defined by the appended claims and their equivalents.

Figure 2:
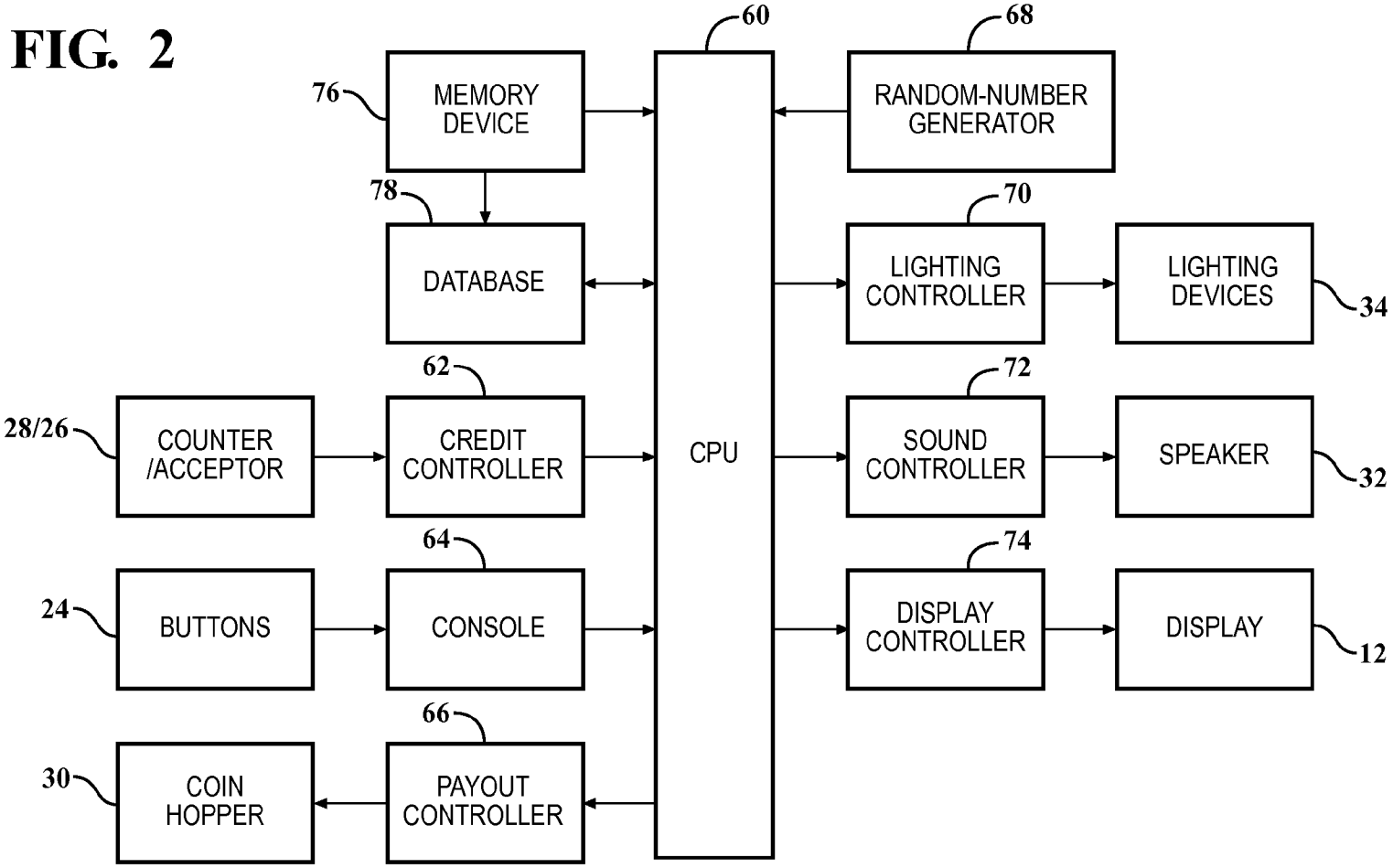
FIG. 2 is a schematic representation of the gaming machine shown in FIG. 1.

FIG. 1 is a perspective view of an exemplary gaming machine 10. FIG. 2 is a schematic representation of the gaming machine 10. A preferred embodiment of the present invention is a video gaming machine preferably installed in a casino. In the illustrated embodiment, the gaming machine 10 includes a display device 12 for displaying a plurality of games, a user input device 14 to enable a player to interface with the gaming machine 10, and a gaming controller 16 that is operatively coupled to the display device 12 and the user input device 14 to enable a player to play games displayed on the display device 12. The gaming machine 10 also includes a cabinet assembly 18 that is configured to support the display device 12, the user input device 14, and/or the gaming controller 16 from a gaming stand 20 and/or a supporting surface 22.

The display device 12 and the user input device 14 are coupled to the cabinet assembly 18 and are accessible by the player. In one embodiment, the gaming controller 16 is positioned within the cabinet assembly 18. Alternatively, the gaming controller 16 may be separated from the cabinet assembly 18, and connected to components of the gaming machine 10 through a network such as, for example, a local area network (LAN), a wide area network (WAN), dial-in-connections, cable modems, wireless modems, and/or special high-speed Integrated Services Digital Network (ISDN) lines.

In one embodiment, the user input device 14 includes a plurality of input buttons 24, a coin slot 26, and/or a bill acceptor 28. The coin slot 26 includes an opening that is configured to receive coins and/or tokens deposited by the player into the gaming machine 10. The gaming machine 10 converts a value of the coins and/or tokens to a corresponding amount of gaming credits that are used by the player to wager on games played on the gaming machine 10.

The bill acceptor 28 includes an input and output device that is configured to accept a bill, a ticket, and/or a cash card into the bill acceptor 28 to enable an amount of gaming credits associated with a monetary value of the bills, ticket, and/or cash card to be credited to the gaming machine 10. Moreover, the gaming machine 10 may also utilize a cashless wagering system (not shown), such as a ticket in ticket out (TITO) system (not shown). In one embodiment, the bill acceptor 28 also includes a printer (not shown) that is configured to dispense a printed voucher ticket that includes information indicative of an amount of credits and/or money paid out to the player by the gaming machine 10 during a gaming session. The voucher ticket may be used at other gaming machines, or redeemed for cash, and/or other items as part of a casino cashless system (not shown).

A coin tray 30 is coupled to the cabinet assembly 18 and is configured to receive a plurality of coins that are dispensed from the gaming machine 10. One or more speakers 32 are installed inside the cabinet assembly 18 to generate voice announcements and/or sound effects associated with game play. The gaming machine 10 also includes one or more lighting devices 34 that are configured to blink and/or change brightness and color in specific patterns to produce lighting effects to enhance a visual gaming experience for the player.

In one embodiment, the input buttons 24 include a plurality of BET switches 36 for inputting a wager on a game, a plurality of selection switches 38 for selecting a betting line and/or card, a MAXBET switch 40 for inputting a maximum wager, a PAYOUT switch 42 for ending a gaming session and dispensing accumulated gaming credits to the player, and a start switch, i.e., a SPIN/DEAL button 44 to initiate an output of a game.

In the illustrated embodiment, the BET switches 36 include five switches from 1BET to 5BET to enable a player to wager between a minimum bet up to 5× minimum bet. Each selection switch 38 corresponds to a betting line such as, for example, a payline and/or symbol for a reel game, one or more cards for a card game, and/or a symbol for a roulette game, to enable a player to associate a wager with one or more betting lines. The MAXBET switch 40 enables a player to input the maximum bet that a player can spend against one time of a game. The PAYOUT switch 42 enables a player to receive the amount of money and/or credits awarded to the player during a gaming session, which has been credited onto the gaming machine 10.

The gaming machine 10 may also include a player tracking device 46 that is coupled to the gaming controller 16 for identifying the player and/or a player tracking account that is associated with the player. The player tracking account may include, but is not limited to, gaming credits available to the player for use in playing the gaming machine 10. The player tracking device 46 is configured to communicate player account information between a player tracking controller (not shown) and the gaming machine 10. For example, the player tracking device 46 may be used to track bonus points and/or credits awarded to the player during a gaming session and/or track bonus and/or credits downloaded to the gaming machine 10 from the player tracking system.

The player tracking device 46 is coupled to the gaming cabinet assembly 18 and includes a player identification card reader 48, a data display 50, and a keypad 52. The player identification card reader 48 is configured to accept a player tracking card (not shown) inserted by the player, and read information contained on the player tracking card to identify the player account information. The player identification card reader 48 may include, but is not limited to, a barcode reader, a magnetic card reader, and/or a radio frequency identification (RFID) card reader. The keypad 52 is configured to accept a user selection input such as, for example, a unique player personal identification number (PIN) to facilitate enabling the gaming machine 10 to identify the player, and access player account information associated with the identified player to be displayed on the data display 50. In one embodiment, the data display 50 includes a touchscreen panel that includes the keypad 52. Alternatively, the data display 50 and the keypad 52 may be included in the display device 12.

In one embodiment, the display device 12 includes a first display 54 and a second display 56. The first display 54 is configured to display a game screen 58 (shown in FIG. 3) including indicia and/or symbols for use in a game, e.g., cards used by a card game, roulette wheel and symbols used in a roulette game, and reels used in a reel game. The game screen 58 may include any type of game including, but not limited to, a video slot game, a keno game, a blackjack game, a video poker game, or any type of game which allows a player to make a wager, play a game, and potentially provide the player an award based on an outcome of the game and a paytable. The second display 56 is configured to display game play instructions for performing the game including, but not limited to, playing instructions, paytables, paylines, betting lines and/or any other information to enable the gaming machine 10 to function as described herein. Moreover, each display 54 and 56 may be configured to display at least a portion of the game screen 58 and/or game play instructions. In one embodiment, the first and second displays 54 and 56 each include a flat panel display, such as a cathode ray tube display (CRT), a liquid crystal display (LCD), a light-emitting diode display (LED), a plasma display, and/or any suitable visual output device capable of displaying graphical data and/or text to a user. Alternatively, a single component, such as a touch screen, may function as both the display device 12 and as the user input device 14. In an alternative embodiment, the first display 54 and/or the second display 56 includes a plurality of mechanical reels displaying a plurality of game symbols.

Referring to FIG. 2, in one embodiment, the gaming controller 16 includes a processor, i.e., a central processing unit (CPU) 60, a credit controller 62, a console unit 64, a payout controller 66, a random-number generator (RNG) 68, a lighting controller 70, a sound controller 72, a display controller 74, a memory device 76, and a database 78. Memory device 76 includes a computer readable medium, such as, without limitation, random access memory (RAM), read-only memory (ROM), erasable programmable read-only memory (EPROM), flash memory, a hard disk drive, a solid state drive, a diskette, a flash drive, a compact disc, a digital video disc, and/or any suitable device that enables the CPU 60 to store, retrieve, and/or execute instructions and/or data.

The CPU 60 executes various programs, and thereby controls other components of the gaming controller 16 according to player instructions and data accepted by the user input device 14. The CPU 60 in particular executes a game program, and thereby conducts a game in accordance with the embodiments described herein. The memory device 76 stores programs and databases used by the CPU 60. Moreover, the memory device 76 stores and retrieves information in the database 78 including, but not limited to, a game type, a number of reels associated with a game, a number of reel strips associated with each reel, a number of symbol positions being displayed on each reel strip, a type of symbols being displayed on each symbol position, a predefined set of normal symbols, a predefined set of special symbols, image data for producing game images and/or screens on the display device 12, and temporarily stores variables, parameters, and the like that are used by the CPU 60. In addition, the memory device 76 stores indicia, symbol weights, paytables, and/or winning combination tables which represent relationships between combinations of random numbers and types of awards. In one embodiment, the memory device 76 utilizes RAM to temporarily store programs and data necessary for the progress of the game, and EPROM to store, in advance, programs and data for controlling basic operation of the gaming machine 10, such as the booting operation thereof.

The credit controller 62 manages the amount of player's credits, which is equivalent to the amount of coins and bills counted and validated by the bill acceptor 28. The console unit 64 is coupled to the user input device 14 to monitor player selections received through the input buttons 24, and accept various instructions and data that a player enters through the input buttons 24. The payout controller 66 converts a player's credits to coins, bills, or other monetary data by using the coin tray 30 and/or for use in dispensing a credit voucher via the bill acceptor 28.

The lighting controller 70 controls one or more lighting devices 34 to blink and/or change brightness and color in specific patterns in order to produces lighting effects associated with game play. The sound controller 72 controls the speakers 32 to output voice announcements and sound effects during game play. The display controller 74 controls the display device 12 to display various images on screens preferably by using computer graphics and image data stored in the memory device 76. More specifically, the display controller 74 controls video reels in a game screen displayed on the first display 54 and/or the second display 56 by using computer graphics and the image data.

The RNG 68 generates and outputs random numbers to the CPU 60 preferably at the start of each round of game. The CPU 60 uses the random numbers to determine an outcome of a game. For example, if the game is a video slot game, the CPU 60 uses the RNG 68 to randomly select an arrangement of symbols to be displayed on video reels. Moreover, the CPU 60 generally uses random numbers generated by the RNG 68 to play the games, and to determine whether or not to provide an award to a player. In addition, the CPU 60 generates game outcomes including combinations of random numbers, and compares the generated combinations with winning combinations stored in the winning combination table to determine if the generated outcome is a winning outcome that is associated with a type of award.

Figure 3:
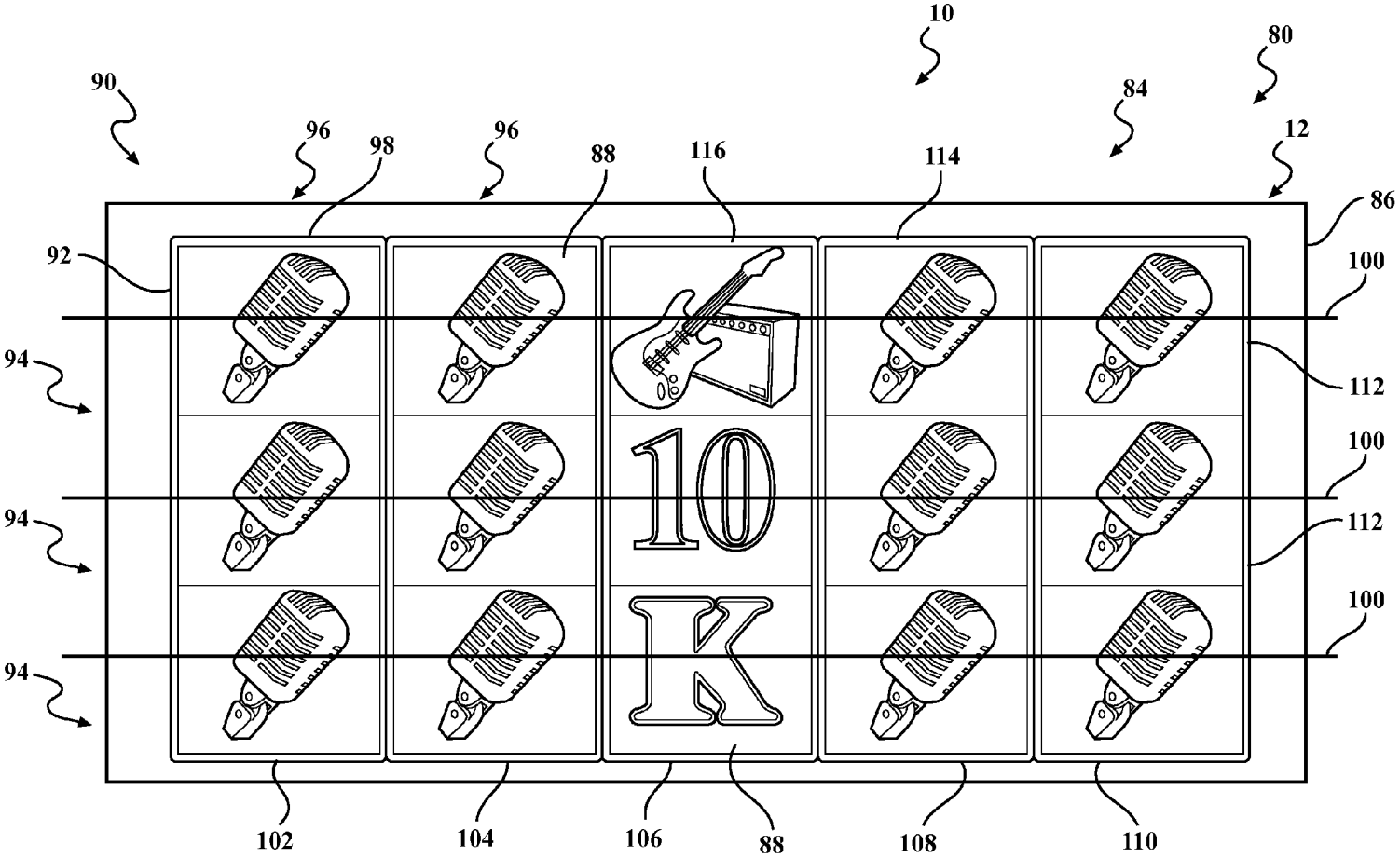
FIG. 3 is a graphical display of a video slot game including a plurality of reels, according to an embodiment of the present invention.
Figure 4:
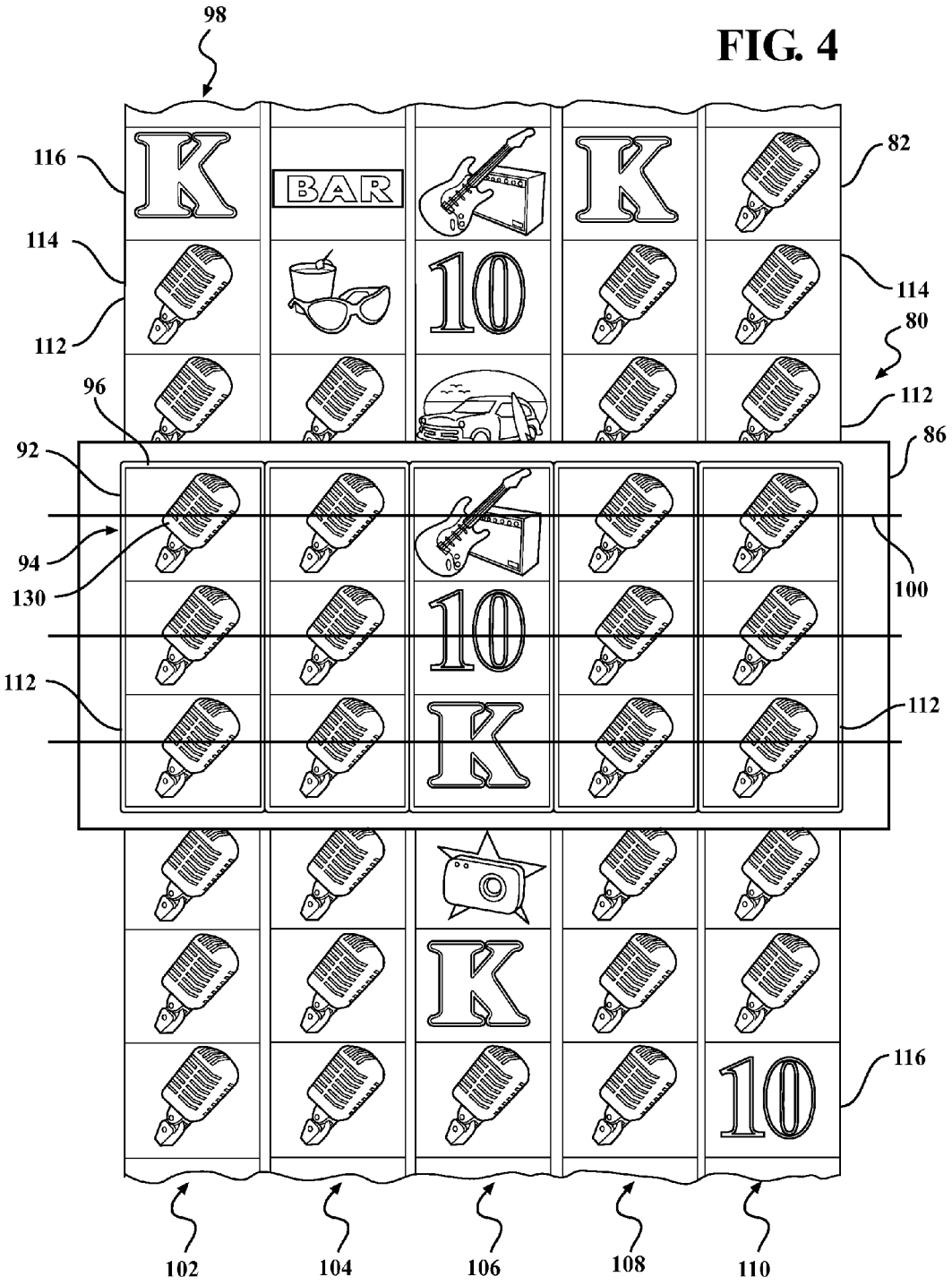
FIG. 4 is a schematic representation of a portion of the gaming machine shown in FIG. 1 including the video slot game of FIG. 3, according to an embodiment of the present invention.
Figure 5:
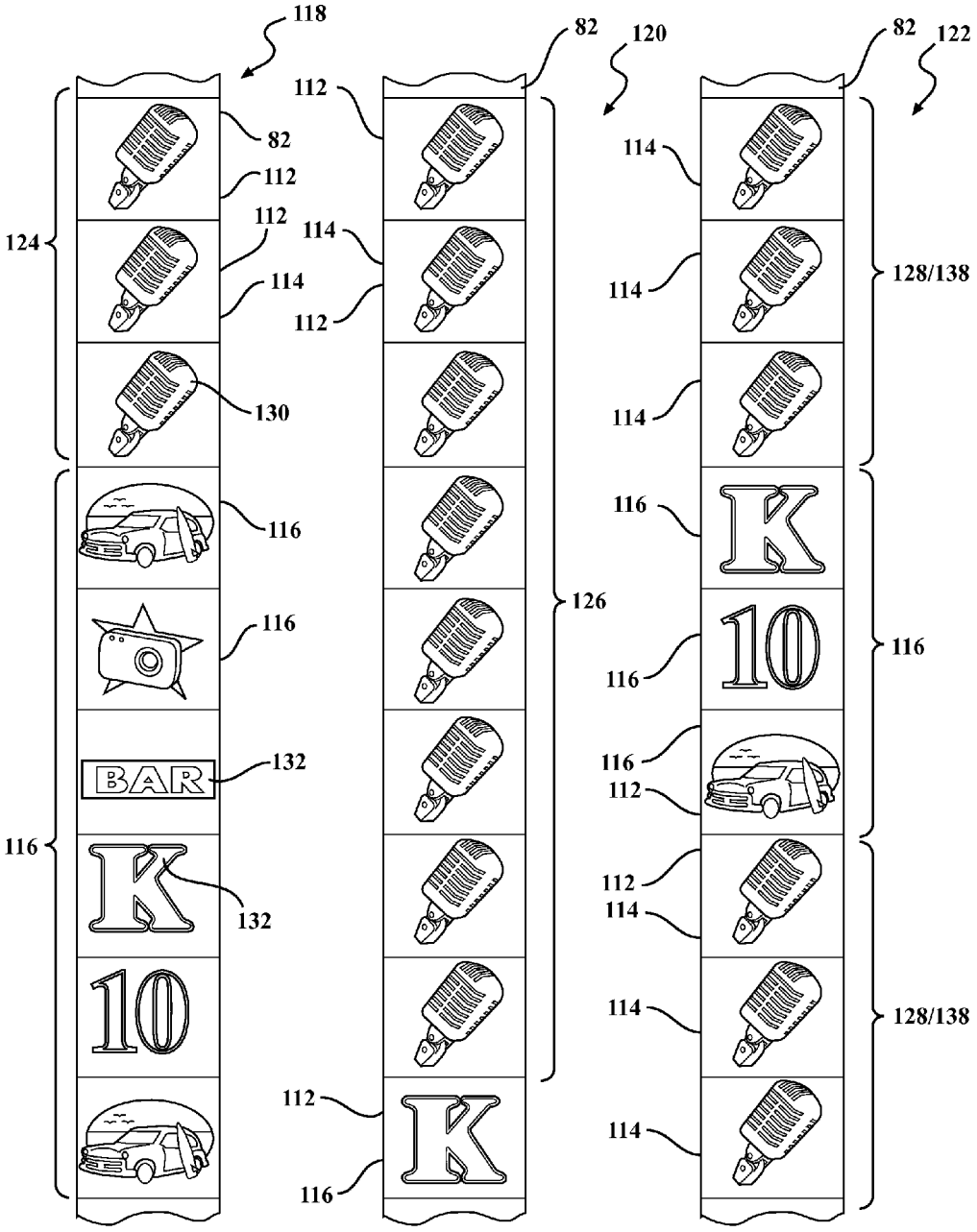
FIG. 5 is a schematic representation of a plurality of reel strips that may be used with at least one slot reel of the video slot game of FIGS. 3 and 4, according to an embodiment of the present invention.
Figure 6:
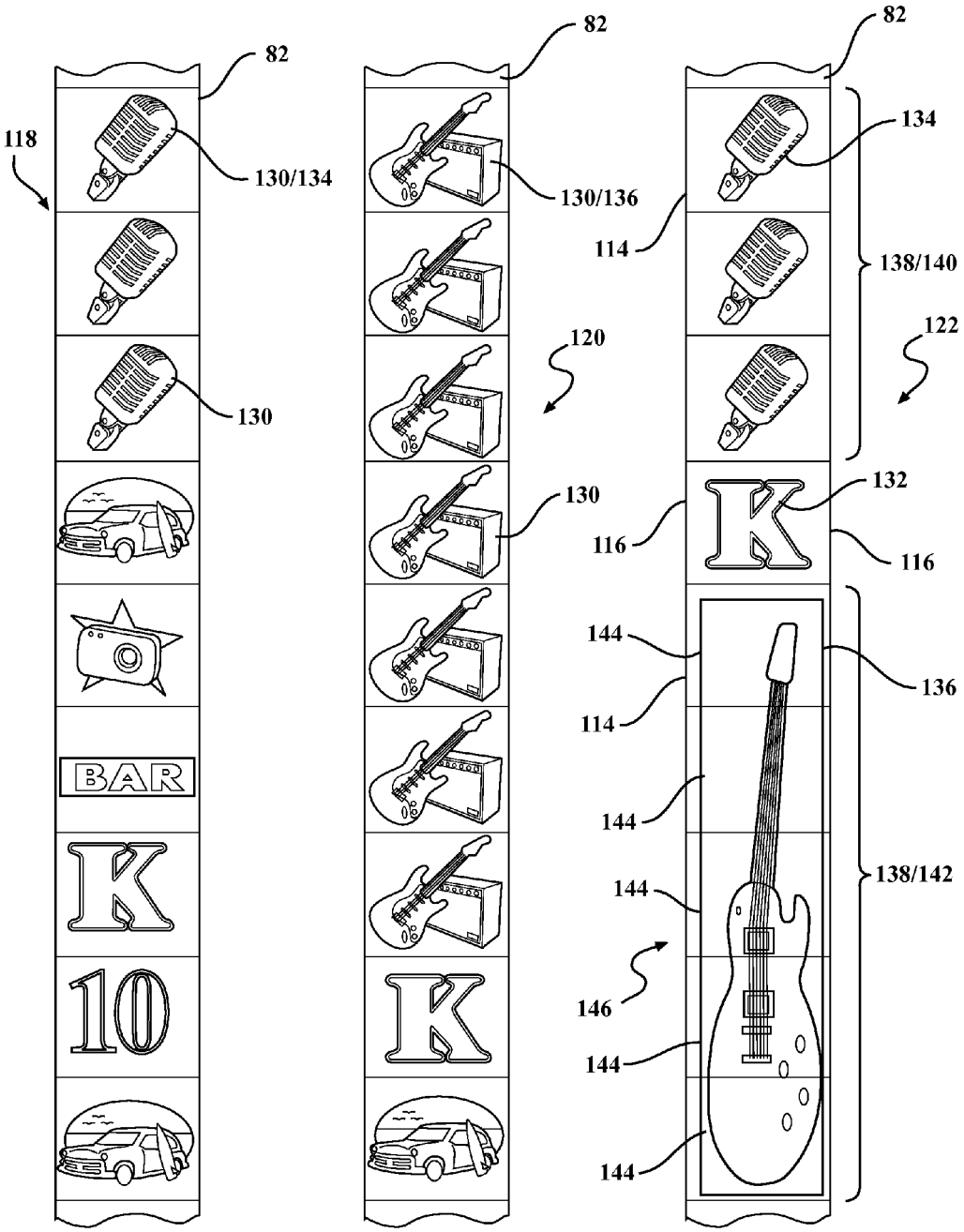
FIG. 6 is another schematic representation of the plurality of reel strips shown in FIG. 5, according to an embodiment of the present invention.

FIG. 3 is an exemplary graphical display of a game 80 that is displayed by the gaming machine 10 shown in FIG. 1. FIG. 4 is a schematic representation of a portion of the gaming machine 10 including the game 80. FIGS. 5 and 6 are schematic representations of a plurality of reel strips 82 that may be used the game 80 shown in FIG. 3. In the illustrated embodiment, the gaming controller 16 is configured to display the game 80 on the display device 12. In one embodiment, the game 80 is a video slot game. However, it should be noted that the game 80 may be any type of game upon which a player could make a wager including, but not limited to a keno game, a blackjack game, a video poker game, or any type of game that enables the gaming machine 10 to function as described herein. In the illustrated embodiment, the game 80 is displayed on the first display 54. Alternatively, the game 80 may be displayed on the first display 54 and/or the second display 56.

In general, during play of the game 80, the gaming controller 16 randomly generates an outcome 84 of the game 80 and displays the generated game outcome 84 in a display area 86. The gaming controller 16 randomly selects a plurality of game symbols 88 from a predefined set of possible game symbols and displays the selected game symbols 88 associated with the generated game outcome 84 in the game display area 86.

In the illustrated embodiment, the plurality of game symbols 88 are displayed in a grid 90 having a plurality of cells 92 arranged along a plurality of rows 94 and a plurality of columns 96. Each cell 92 displays one or more game symbols 88 associated with the game outcome 84. In the illustrated embodiment, the gaming controller 16 displays the game symbols 88 within a plurality of reels 98. Each reel 98 is associated with a corresponding column 96. The game 80, in one embodiment, includes 5 reels 98 with 3 cells 92 displayed in the display area 86 per reel 98 (a "3×5" arrangement). Alternatively, other reel arrangements may be used such as, for example, 4, 5, 5, 5, and 4 cells per reel, respectively (a "4-5-5-5-4" arrangement), 3-4-3-4-3, or 4-5-4-5-4 arrangements or arrangements with the same number of cells per column, such as 3×3, 3×4, 4×5, or 5×5 configurations. The game 80 also includes a plurality of paylines 100 that extend across one or more cells 92 to indicate, to the player, a combination of game symbols 88. In one embodiment, the gaming machine 10 displays the game 80 via a plurality of mechanical reels (not shown) that include a plurality of symbols displayed on a circumferential surface of each reel.

Each slot game is generally played in a conventional manner. The player makes a wager, which may be based on a predetermined denomination and a selected number of paylines, the gaming controller 16 randomly generates an outcome for the game, spins the reels, and selectively stops the reels to display a game symbol 88 in each of the display cells 92. If a predetermined pattern of symbols 88 is randomly chosen for each cell 92 associated with a played payline 100, the player may be awarded a payout based on the payline, the wager, and a predetermined paytable. Moreover, the player may be awarded a payout if the combination of symbols associated with a selected payline is a winning combination. In addition, a player may receive a bonus feature and/or a bonus game based on the combination of symbols associated with the selected payline and/or the appearance of one or more predefined symbols in the game outcome 84. Many variations to the above described general play of a slot game fall within the scope of the present invention. Such slot games are well-known in the art, and are therefore not further discussed.

In the illustrated embodiment, the gaming machine 10 receives a signal, from the user input device 14, that is indicative of a player's selection to initiate a gaming session including a wager amount, and a selection of one or more paylines 100 associated with a predefined set of cells 92 within the displayed grid 90. In the illustrated embodiment, the gaming machine 10 is a multi-line game, i.e., the paylines include horizontal paylines and/or diagonal paylines, and/or zig-zag paylines. Moreover, the user input device 14 may allow the player to toggle to increase the bet per payline a credit at a time (up to the maximum bet). The gaming controller 16 randomly generates an outcome of the game 80, and displays the generated outcome on the display device 12. In one embodiment, the gaming controller 16 is configured to rotate, and/or spin each reel 98 to initiate a game play, and stop each reel 98 to display a plurality of symbols 88 associated with the randomly generated outcome. In addition, the gaming controller 16 is adapted to determine if the generated outcome is a winning outcome based on the displayed game symbols 88, a pay-table, a wager, and one or more selected paylines 100. More specifically, the gaming machine 10 determines if a combination of symbols 88 arranged along the selected payline 100 is a winning combination. The gaming controller 16 may provide an award in response to the outcome of the game 80. In general, the term "award" may be a payout, in terms of credits or money. Thus, gaming controller 16 may award a regular payout in response to the outcome of the game 80.

However, it should be noted that the term award may also refer to other types of awards, including, prizes, e.g., meals, show tickets, etc. . . . , as well as in-game awards, such as free games or awarding the player one or more wild symbols or stacked wild symbols in each of the games.

The gaming controller 16 is configured to display the game 80 including a plurality of reels 98. For example, in one embodiment, the gaming controller 16 displays the game 80 having five reels 98 orientated horizontally including a $1^{st}$ reel 102, a $2^{nd}$ reel 104, a $3^{rd}$ reel 106, a $4^{th}$ reel 108, and a $5^{th}$ reel 110. Each reel 98 may have a plurality of associated reel strips 82 that may be displayed on the respective reel 98. Each reel strip 82 includes a plurality of symbol positions 112. During display of the generated game outcome 84, the gaming controller 16 selects a reel strip 82 to be displayed on at least one of the reels 98, selects a plurality of game symbols 88 being displayed in each of the symbol positions 112 of each selected reel strip 82, and spins each reel 98 such the game symbols 88 are moved through each of the cells 92 in the display area 86.

The gaming controller 16 also includes a group of reel strips 82 associated with at least one of the reels 98. For example, in one embodiment, the gaming controller 16 may include a group including two reel strips 82 associated with each reel 98. Alternatively, the gaming controller 16 may include a group including more than two reel strips 82 associated with each reel 98. Moreover, in another embodiment, each reel 98 may include a group having a different number of reel strips 82 associated with the corresponding reel 98 such that, for example, for the $1^{st}$ reel 102 the gaming controller 16 selects from a group having two reel strips 82 associated with the $1^{st}$ reel 102, and for the $2^{nd}$ reel 104 the gaming controller 16 selects from a group having three reel strips 82 associated with the $2^{nd}$ reel 104. One or more of the reels 98 may only have a single associated reel strip 82.

In the illustrated embodiment, the gaming controller 16 randomly selects one reel strip 82 of the plurality of reel strips 82 and displays the reel 98 with the selected reel strip 82 during the display of the game outcome. Each reel strip 82 includes a plurality of symbol positions 112 that includes a plurality of special symbol positions 114 and a plurality of normal symbol positions 116.

In the illustrated embodiment, the gaming controller 16 displays the game 80 having a first reel 102 displayed with one reel strip 82 of the plurality of reel strips 82. In one embodiment, the plurality of reel strips 82 includes a first reel strip 118, a second reel strip 120, and a third reel strip 122, as shown in FIG. 5. The first reel strip 118 includes a first number 124 of special symbol positions 114 and the second reel strip 120 includes a second number 126 of special symbol positions 114 that is different than the first number 124 of special symbol positions. In addition, the third reel strip 122 includes a third number 128 of special symbol positions 114 that is different than the first number 124 and the second number 126 of special symbol positions 114. Alternatively, the third reel strip 122 may include a number of special symbol positions 114 that is equal to the first reel strip 118 and/or the second reel strip 120.

The gaming controller 16 randomly selects one of the first reel strip 118, the second reel strip, and the third reel strip 122 and displays the selected reel strip 82 with the first reel 102. In addition, the gaming controller 16 may randomly select at least one special symbol 130 from a plurality of special symbols including a predefined set of special symbols 130 and displays the selected special symbol 130 displayed within each special symbol position 114. The gaming controller 16 spins and stops the first reel 102 to display the generated game outcome 84 within the display area 86 including the selected reel strip 82 having the selected special symbol 130 being displayed in each special symbol position 114.

In the illustrated embodiment, the gaming controller 16 displays the same special symbol 130 in each special symbol position 114. Alternatively, the gaming controller 16 may select a plurality of similar special symbols and/or a plurality of associated special symbols such as, for example, a set of special symbols included in a category of special symbols, and display the plurality of similar and/or associated special symbols 130 in each special symbol position 114. For example, the predefined set of special symbols may include, but is not limited to, a category of special symbols such as, for example, shapes, colors, sounds, items, characters, backgrounds, frames, and/or any category of special symbols that enable the gaming controller 16 to function as described herein. Each special symbol category includes a plurality of special symbols having predefined characteristics associated with the special symbol category. For example, the predefined set of special symbols may include a shape category that includes a plurality of special symbols that each have a shape associated with the shape category. The gaming controller 16 may select one or more special symbols indicative of the shapes within the shape category, and display the selected special symbols in each of the special symbol positions 114.

In the illustrated embodiment, each reel 82 includes a plurality of static normal symbols 118 that are displayed in each corresponding normal symbol positions 114, such that the same normal symbol 118 is displayed in the corresponding normal symbol position 114 in each game outcome 84. Alternatively, the gaming controller 16 may randomly select a plurality of normal symbols 118 from a predefined set of normal symbols 118, and display the selected normal symbols 118 within each of the normal symbol positions 114 such that, for each game outcome 84, each normal symbol position 114 may display a different normal symbol 118. In one embodiment, the predefined set of normal symbols 118 includes any game symbol not included in the predefined set of special symbols 116.

In one embodiment, each special symbol 130 includes an associated symbol value. For example, the plurality of special symbols 130 may include a first special symbol 134 having a first symbol value and a second special symbol 136 having a second symbol value that is different than the first symbol value. Moreover, the gaming controller 16 may provide a first award indicative of a first award value for achieving a winning combination having the first special symbol 134, and provide a second award indicative of a second award value for achieving a winning combination that includes the second special symbol 136, wherein the first award value is different than the second award value. In addition, the gaming controller may randomly select a special symbol 130 having an associated symbol value and select one reel strip 82 of the plurality of reel strips 82 based at least in part on the selected special symbol associated value.

In the illustrated embodiment, at least one reel strip 82 includes at least one group 138 including adjacent special symbol positions 114. The gaming controller 16 also randomly selects a special symbol 130 being displayed in each special symbol position 114 of the group 138 of adjacent special symbol positions 114 such that each adjacent special symbol position 114 includes the selected special symbol 130. Additional details of adjacent special symbol positions, which may be used in the present invention, are described in U.S. patent application Ser. No. 11/299,009 to Yoshimi, now U.S. Pat. No. 8,096,869, filed Dec. 9, 2005, titled "Gaming Machine with Runs of Consecutive Identical Symbols", which is incorporated herein by reference.

In one embodiment, at least one reel strip 82 such as, for example, the third reel strip 122 includes a plurality of groups 138 of adjacent special symbol positions 114. The gaming controller 16 randomly selects a special symbol 130 and displays the selected special symbol 130 in each special symbol position 114 of the selected number of groups 138. In addition, the gaming controller 16 displays at least one normal symbol position 116 between two of the groups 138 of adjacent special symbol positions 114. In another embodiment, the gaming controller 16 randomly selects a plurality of special symbols 130 associated with each of the groups 138 and displays a corresponding selected special symbol 130 in each special symbol position 114 of the associated group 138. For example, in one embodiment, the gaming controller 16 includes a reel strip 82, such as for example, the third reel strip 122 having a first group 140 of adjacent special symbol positions 114 and a second group 142 of adjacent special symbol positions 114. The gaming controller 16 selects a first special symbol 134 and a second special symbol 136. The gaming controller 16 also displays the first group 140 having the first special symbol 134 within each special symbol position 114 of the first group 140 and displays the second group 142 having the second special symbol 136 within each special symbol position 114 of the second group 142.

In one embodiment, the first special symbol 134 and the second special symbol 136 are different, as shown in FIG. 6. In another embodiment, the first special symbol 134 and the second special symbol 136 are similar. Moreover, the first and second special symbols 134 and 136 may be the same special symbol, as shown in FIG. 5. In addition, the first and second special symbols 134 and 136 may be selected from the same category of special symbols and/or be selected from different categories of special symbols.

Referring again to FIG. 6, the gaming controller 16 may randomly select a first special symbol 134 being displayed on the first reel strip 118, and select a second special symbol 136 being displayed on second reel strip 120. The gaming controller 16 may also randomly selected one of the first and second reel strips 118 and 120 and display the first reel 102 including the selected reel strip 82 having the associated selected special symbol 130.

In the illustrated embodiment, the gaming controller 16 displays the game 80 including a plurality of reels 98 and, for each reel 98, randomly selects one reel strip 82 from a predefined set of reel strips 82, and displays each reel 98 having the corresponding selected reel strip 82. In one embodiment, the gaming controller 16 displays the game 80 including the first reel 102 and the second reel 104, randomly selects one of the first reel strip 118, the second reel strip 120, or the third reel strip 122 for display on the first reel 102, and randomly selects one of the first reel strip 118, the second reel strip 120, or the third reel strip 122 for display on the second reel 104. Accordingly, the game 80 may be displayed with the first and second reels 102 and 104 being displayed with the same selected reel strip 82 or being displayed with different selected reel strips 82.

In the illustrated embodiment, the gaming controller 16 also randomly selects a special symbol 130 that is displayed in each special symbol position 114 displayed on the first and second reels 102 and 104. In another embodiment, the gaming controller 16 randomly selects a first special symbol 134 being displayed on the first reel 102 and randomly selects a second special symbol 136 being displayed on the second reel 104, wherein the second special symbol 136 is different than the first special symbol 134. In other embodiments, the first and second special symbols 134 and 136 may be similar, may be selected from the same special symbol category, and/or may be selected from different special symbol categories.

Referring to FIGS. 4 and 6, in one embodiment, the gaming controller 16 displays the game including a special symbol 130 having a plurality of symbol images 144 such that a plurality of adjacent special symbols 130 are displayed as a unitary image 146 that extends across each of the adjacent special symbol positions 114. For example, as shown in FIG. 6, for the third reel strip 122, the gaming controller 16 randomly selects a special symbol 130 being displayed in each special symbol position of the group 138, wherein the selected special symbol includes a plurality of symbol images 144. Each selected special symbol 130 being displayed in each of the adjacent special symbol positions 114 includes a different symbol image 144 such that a unitary symbol image 146 extends across each adjacent special symbol position 114. For example, as shown in FIG. 6, the gaming controller 16 may display each selected special symbol 130 having a different symbol image 144 such that a unitary guitar image 148 is displayed across each adjacent special symbol position 114. In another embodiment, the gaming controller 16 selects a plurality of special symbols 130 from the same category of special symbols, wherein each selected special symbol 130 forms a portion of the unitary symbol image 146 such that when the selected special symbols 130 are displayed in each adjacent special symbol position 114, the unitary symbol image 146 is displayed across the adjacent special symbol positions 114.

Figure 7:
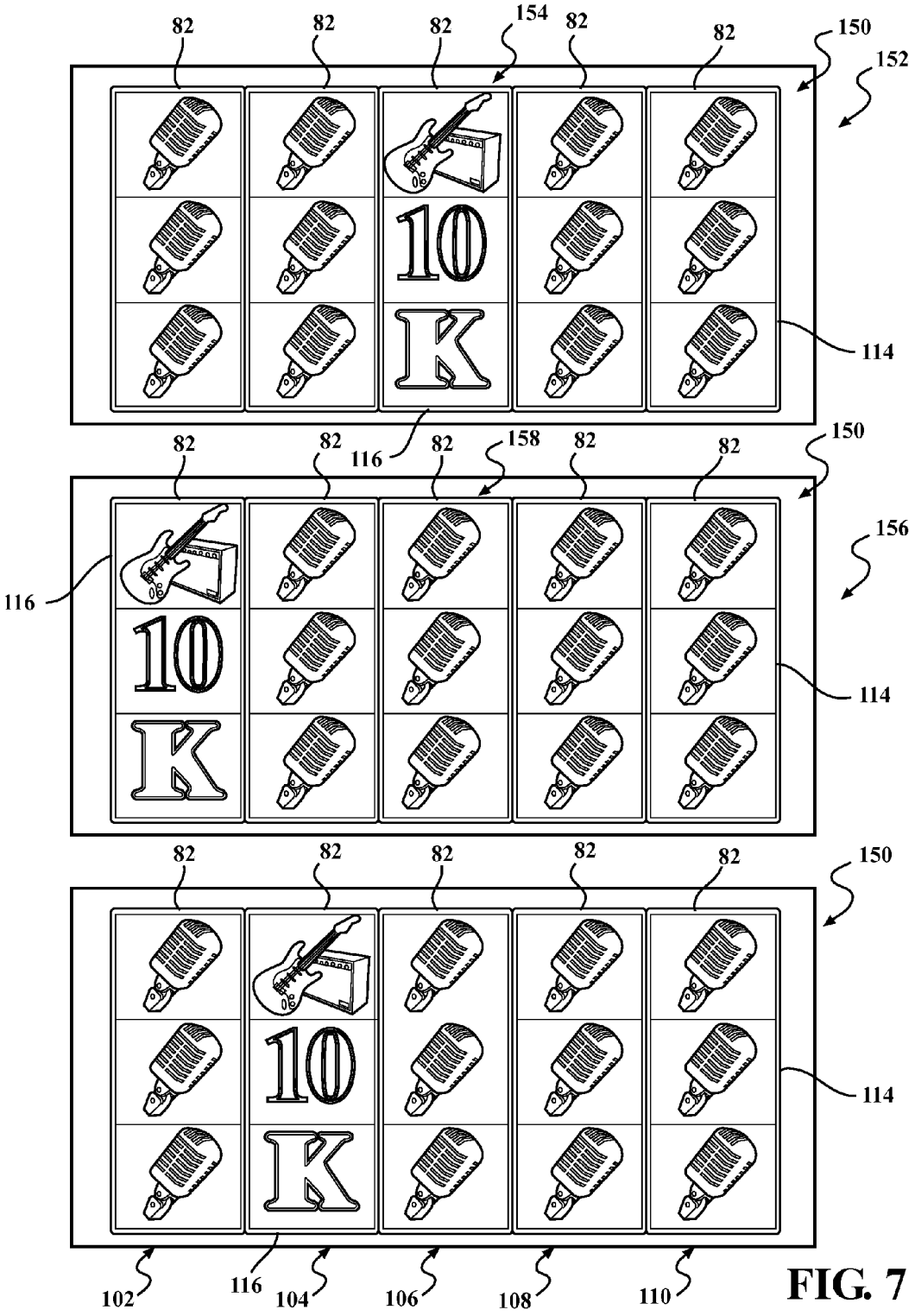
FIG. 7 is a schematic representation of a plurality of reel sets that may be used with the video slot game shown in FIG. 3, according to an embodiment of the present invention.
Figure 8:
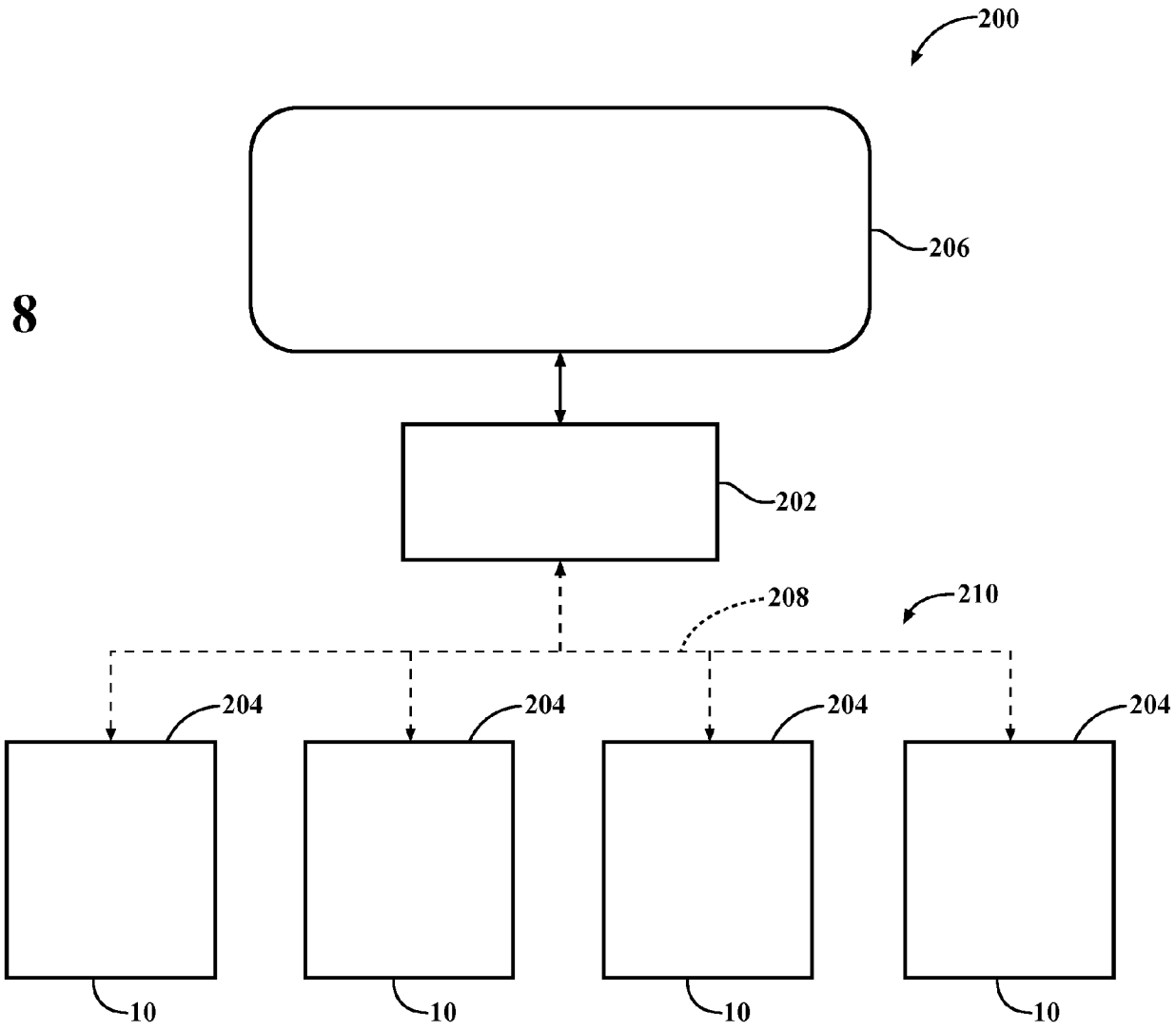
FIG. 8 is a schematic view of an exemplary gaming system of the present invention.

FIG. 7 is a schematic representation of a plurality of reel sets 150 that may be used with the game 80 shown in FIG. 3. In the illustrated embodiment, the gaming controller 16 displays the game 80 including a plurality of reel sets 150. Each reel set 150 includes a combination of reel strips 82 having one of the plurality of reel strips 82 being displayed in each reel 98. For example, in one embodiment, the gaming controller 16 determines a first reel set 152 including a first combination 154 of reel strips 82 and determines a second reel set 156 including a second combination 158 of reel strips 82 that is different than the first combination 154. The gaming controller 16 randomly selects the first combination 154 or the second combination 158 and displays the game 80 including each reel 98 being displayed with the associated reel strip 82 included in the selected reel set 150.

For example, the number of reel sets displayed in the game 80 may be provided as in the following chart, including the reel strips 82 included in each reel set 150, and associated with each reel 98. The chart also includes the number of special symbol positions 114 included in each reel strip 82. In the following table, the gaming controller 16 includes a first reel strip e.g., a "rich" reel strip R that includes 80 special symbol positions 114 and a second reel strip e.g., a "poor" reel strip P that includes 20 special symbol positions 114.

| | | Reel Strip included in Each Reel | | | | |
|---|---|---|---|---|---|---|
| $P_{(R)}$ | Reel Set | Reel 1 | Reel 2 | Reel 3 | Reel 4 | Reel 5 |
| 2% | A | R | R | R | R | R |
| 33% | B | R | R | P | R | R |
| 5% | C | R | R | R | P | R |

-continued

| | | Reel Strip included in Each Reel | | | | |
|---|---|---|---|---|---|---|
| $P(_R)$ | Reel Set | Reel 1 | Reel 2 | Reel 3 | Reel 4 | Reel 5 |
| 27% | D | R | P | R | R | R |
| 30% | C | P | R | R | R | R |
| 3% | E | R | R | R | R | P |

The first column represents the probability of occurrence, $P(_R)$ associated with each reel set 150. The second column represents each reel set 150. The third column represents the reel strip 82 associated with the $1^{st}$ reel and corresponding to the reel set 150. The fourth column represents the reel strip 82 associated with the $2^{nd}$ reel and corresponding to the reel set 150. The fifth, sixth, and seventh columns represent the reel strips 82 associated with the $3^{rd}$, $4^{th}$, and $5^{th}$, reels, respectively.

In the illustrated embodiment, during each play of the game 80, the gaming controller 16 randomly selects a reel set 150 based on the probabilities assigned to each reel set 150 as shown in the first column and determines the reel strip 82 being displayed in each reel 98 based on the selected reel set 150. In addition, the gaming controller 16 determines the number of special symbol positions 114 being displayed in each reel 98 based on the corresponding reel strip 82. For example, if the gaming controller 16 randomly selects reel set "C" based on the associated probability of occurrence, the gaming controller 16 displays the game 80 including a reel set combination including R, R, R, P, R, such that the game 80 includes 80 special symbol positions 114 being displayed in the $1^{st}$ reel, 80 special symbol positions being displayed in the $2^{nd}$ reel, 80 special symbol positions being displays in the $3^{rd}$ reel, 20 special symbol positions being displayed in the $4^{th}$ reel, and 80 special symbol positions being displayed in the $5^{th}$ reel. In the illustrated embodiment, the gaming controller 16 includes a first and second reels strip. Alternatively, the gaming controller 16 may include any number of reel strips that may be selected for display in each of the reels 98.

In another embodiment, the gaming controller 16 includes a probability of occurrence associated with each reel strip 82. For example, in one embodiment, the gaming controller 16 determines a probability associated with the first reel strip R and determines a probability associated with the second reel strip P. In addition, for each reel 98, the gaming controller 16 determines a different probability of occurrence for the first and second reel strips R and P. Moreover, the gaming controller 16 may randomly select a special symbol 130 and determine the first and second reel strip probabilities based on the selected special symbol 130.

For example, for each reel 98, the probability of selecting the first or the second reel strips R and P being displayed in the game 80 may be provided as in the following chart, including the selected special symbol 130 and the corresponding probabilities associated with each reel strip for each reel. In the following table, the gaming controller 16 includes a first reel strip e.g., a "rich" reel strip R that includes 80 special symbol positions 114 and a second reel strip e.g., a "poor" reel strip P that includes 20 special symbol positions 114.

| | Probability P(rs) of Reel Strip Being Displayed in Reel | | | | | | | | | |
|---|---|---|---|---|---|---|---|---|---|---|
| Special | Reel 1 | | Reel 2 | | Reel 3 | | Reel 4 | | Reel 5 | |
| Symbol | R | P | R | P | R | P | R | P | R | P |
| Symbol 1 | 15% | 85% | 15% | 85% | 5% | 95% | 15% | 85% | 15% | 85% |
| Symbol 2 | 80% | 20% | 80% | 20% | 10% | 90% | 80% | 20% | 80% | 20% |
| Symbol 3 | 70% | 30% | 70% | 30% | 15% | 85% | 70% | 30% | 70% | 30% |
| Symbol 4 | 50% | 50% | 50% | 50% | 30% | 70% | 50% | 50% | 50% | 50% |
| Symbol 5 | 75% | 25% | 75% | 25% | 50% | 50% | 75% | 25% | 75% | 25% |

The first column represents the selected special symbol 130. The second major column represents the probability of the first reel strip R and the probability of the second reel strip P being displayed in the $1^{st}$ reel and corresponding to with the selected special symbol. Each associated probability P(rs) is shown in the corresponding sub-columns. The third major column represents the probability of the first reel strip R and the probability of the second reel strip P being displayed in the $2^{nd}$ reel. The fifth, sixth, and seventh columns represent the probability of the reel strips being displayed on the $3^{rd}$, $4^{th}$, and $5^{th}$ reels, respectively.

In the illustrated embodiment, during each play of the game 80, the gaming controller 16 randomly selects a special symbol 130, determines, for each reel, the probability of selecting the first reel strip R or the second reel strip P, randomly selects the first or second reel strips R and P, and displays each reel 98 including the selected reel strip 82 having the corresponding number of special symbol positions 114. For example, if the gaming controller 16 randomly selects special symbol 2, the gaming controller 16 determines the probability of the first reel strip R being displayed on the 1st reel being equal to 80% and the probability of the second reel strip P being displayed on the $1^{st}$ reel being equal to 20%. Moreover, based on the probabilities corresponding with the special symbol 2, the gaming controller 16 is more likely to select a "rich" reel strip R having a higher number of special symbol positions for the $1^{st}$, $2^{nd}$, $4^{th}$ and $5^{th}$ reels and select a "poor" reel strip P having a lower number of special symbol positions for the $3^{rd}$ reel.

Figure 9:
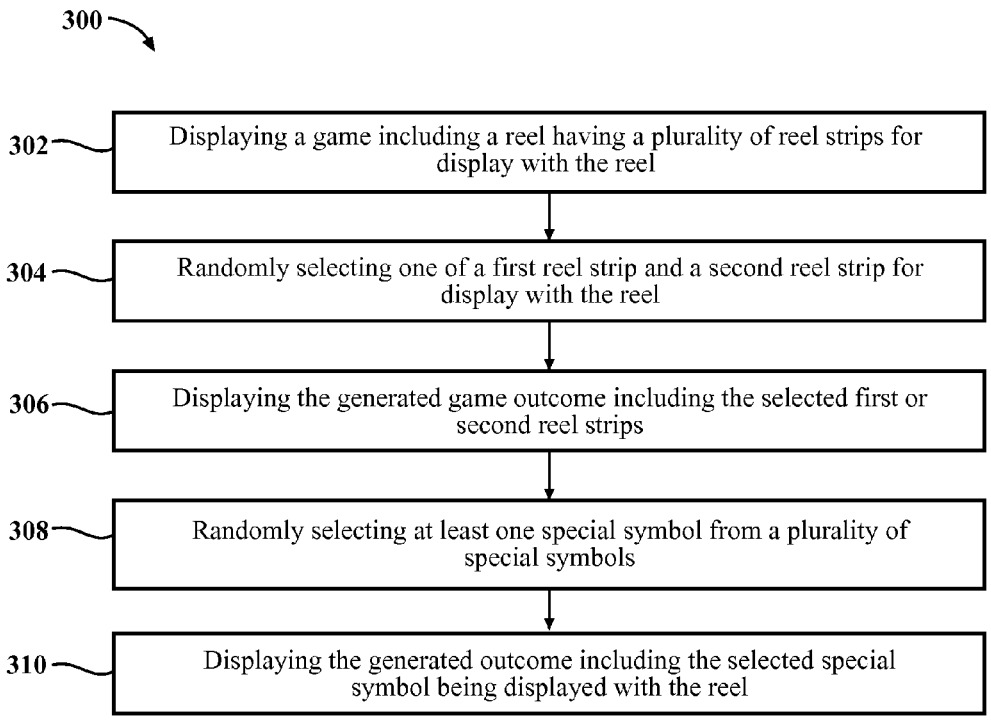
FIG. 9 is a flowchart of an exemplary method of allowing a player to play a gaming machine, according to an embodiment of the present invention.

FIG. 9 is a schematic view of an exemplary gaming system 200. The gaming system 200 includes a system controller 202 and one or more gaming terminals 204 that are coupled to the system controller 202. The gaming system 200 may also include a central display 206 that is coupled to the system controller 202 for displaying games played on one or more of the gaming machines 10. In one embodiment, the gaming terminal 204 includes the gaming machine 10. In another embodiment, gaming terminal 204 may include a personal computer, laptop, cell phone, smartphone, tablet computer, personal data assistant, and/or any suitable computing device that enables a player to connect to system controller 202 to play the game 80.

In the illustrated embodiment, the gaming machines 10 and the system controller 202 are coupled in communication with a local area network (LAN) 208. Alternatively, the gaming machines 10 and the system controller 202 may be coupled via a network such as, for example, an Internet link, an intranet, a WAN, dial-in-connections, cable modems, wireless modems, and/or ISDN lines. In the illustrated embodiment, the gaming system 200 includes four gaming machines 10, which in one embodiment as shown in FIG. 9 are arranged in a bank 210, i.e., are arranged together, adjacently. It should be noted, however, that the gaming system 200 may include any number of gaming machines 10 that may be arranged in any manner, such as in a circle or along a curved arc, or positioned within separate areas of a casino floor, and/or separate gaming establishments such as different casinos. Furthermore, additional groups of gaming machines 10 may be coupled to the system controller 202. In one embodiment, the system controller 202 may be implemented by one of the gaming controllers 16 associated with a gaming machine 10. In still another embodiment, the system controller 202 may be located remotely with respect to gaming machines 10, or within one of the gaming machine cabinet assemblies 18 (shown in FIG. 1). The system controller 202 is configured to perform all of the functions of the gaming controller 16 as described herein.

In the illustrated embodiment, the system controller 202 determines if a triggering event occurs in a game outcome being played at one or more of the gaming machines 10, and displays a bonus game such as, for example, the game 80 on the central display 206 if the triggering event occurs. Alternatively, the system controller 202 may display the game 80 at one or more gaming machines 10 based on one or more triggering events occurring in games played at the gaming machines 10. The triggering event may be the appearance of a predefined symbol and/or a predefined symbol combination in a game outcome.

Referring to FIGS. 9 and 4, during play of the bonus game 80, the system controller 202 determines a number of game outcomes, i.e., free spins that will be displayed based at least in part on the triggering event. The system controller 202 displays, for each bonus game 80, at least one reel 98 having a plurality of reel strips 82. Each reel strip 82 includes a plurality of special symbol positions 114 and a plurality of normal symbol positions 116, wherein the number of special symbol positions 114 in each reel strip 82 being different. The system controller 202 randomly selects one reel strip 82 of the plurality of reel strips 82 and displays the reel 98 with the selected reel strip 82 during the display of the game outcome.

FIG. 10 is a flowchart of an exemplary method 300 of allowing a player to play the gaming machine 10. In the illustrated embodiment, the method 300 includes displaying 302 the game 80 including at least one reel and a plurality of reel strips for display on the at least one reel. The plurality of reel strips includes a first reel strip having a number of special symbol positions and a second reel strip having a different number of special symbol positions. The method 300 also includes randomly selecting 304 one of a first reel strip and a second reel strip for display on the at least one reel, and displaying 306 the generated game outcome including the selected one of the first and second reel strips. The method 300 also includes randomly 308 selecting at least one special symbol from a plurality of special symbols and displaying 310 the generated outcome including the selected special symbol being displayed in each of the special symbol positions.

An exemplary technical effect of the methods, systems, and computers described herein includes at least one of (a) displaying, on a display device, a game including at least one reel and a plurality of reel strips; (b) randomly generating an outcome of the game and displaying the game outcome on the display device; (c) randomly selecting one of a first reel strip and a second reel strip of the plurality of reel strips for display on the at least one reel; and (d) spinning and stopping the at least one reel to display the generated game outcome, the at least one reel including the selected one of the first and second reel strips.

The above-described systems and methods overcome at least some disadvantages of known gaming machines by displays a game including a plurality of reels and selectively displays one of a plurality of reel strips with each of the game reels to facilitate increasing a player's expectation of achieving a winning combination in the generated game. More specifically, the gaming machine randomly selects one of a plurality of reels strips, wherein each of the plurality of reel strips includes a different number of special symbol positions, and randomly selects a special symbol being displayed in each of the special symbol positions displayed in each of the reels. By providing a gaming machine that randomly selects one of a plurality of reel strips including a number of special symbol positions for each of the game reels, the player's expectation for achieving a win is increased and the enjoyment of the game is improved. Thus, the enjoyment of a video game is improved and the amount of time that the video game is played by patrons of a gaming establishment is thereby increased.

Exemplary embodiments of a gaming machine, a gaming system, and a method of allowing a player to play a gaming machine are described above in detail. The gaming machine, system, and method are not limited to the specific embodiments described herein, but rather, components of the gaming machine and/or system and/or steps of the method may be utilized independently and separately from other components and/or steps described herein. For example, the gaming machine may also be used in combination with other gaming systems and methods, and is not limited to practice with only the gaming machine as described herein. Rather, an exemplary embodiment can be implemented and utilized in connection with many other gaming system applications.

A controller, computing device, or computer, such as described herein, includes at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the present invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A method of allowing a player to play a gaming machine, comprising the steps of:

accepting, via an acceptor of the gaming machine, physical media indicating a monetary value to establish a credit balance;

allowing a player, via an input device of the gaming machine, to place a wager on a game playable on the gaming machine, the wager being deducted from the credit balance;

displaying, by a controller on a display device, a game including a plurality of reels, at least one reel of the plurality of reels including a plurality of reel strips for display with the at least one reel, each reel strip of the plurality of reel strips including a plurality of normal symbol positions and a plurality of special symbol positions including at least one group of adjacent special symbol positions, the plurality of reel strips including a first reel strip having a first number of special symbol positions and a second reel strip having a second number of special symbol positions that is different than the first number of special symbol positions;

randomly selecting, by the controller, a first symbol from a predefined set of symbols stored in a database, the database including a list of selection probabilities associated with the first and second reel strips, the list of selection probabilities including a set of selection probabilities associated with each symbol of the predefined set of symbols, each set of selection probabilities including a first selection probability associated with the first reel strip and a second selection probability associated with the second reel strip;

determining from the list of selection probabilities, by the controller, a corresponding set of selection probabilities associated with the selected first symbol;

randomly selecting one of the first reel strip and the second reel strip as a function of the corresponding set of selection probabilities;

displaying the at least one reel with the selected reel strip including the first symbol being displayed in each symbol position included in the at least one group of adjacent special symbol positions; and randomly generating an outcome of the game and spinning and stopping the plurality of reels to display the generated game outcome; providing, by the controller, an award to the player, if any, based on the generated game outcome, the award being added to the credit balance.

2. The method in accordance with claim 1, further comprising the steps of:

displaying the game including a plurality of special symbols and a plurality of normal symbols; and selecting the first symbol from the plurality of special symbols.

3. The method of claim 1, wherein the plurality of special symbol positions includes a first group of adjacent special symbol positions and a second group of adjacent special symbol positions.

4. The method of claim 3, further comprising the steps of:

randomly selecting a second symbol;

displaying the first symbol within each of the first group special symbol positions; and displaying the second symbol within each of the second group special symbol positions.

5. The method of claim 3, wherein the first reel strip including a first number of groups of special symbol positions and the second reel strip including a second number of groups of special symbol positions that is different than the first number of groups.

6. The method of claim 1, further comprising the steps of:

randomly selecting one of the first reel strip and the second reel strip for each reel of the plurality of reels.

7. The method of claim 6, the selection probabilities associated with the first and the second reels strips being different for each of the plurality of reels.

8. The method of claim 1, further comprising the steps of:

displaying the game including a plurality of reel sets, each reel set of the plurality of reel sets including a combination of reel strips including one of the first reel strip and the second reel strip associated with each reel of the plurality of reels;

determining a first reel set including a first combination of reel strips;

determining a second reel set including a second combination of reel strips that is different than the first combination of reel strips;

randomly selecting one of the first reel set and the second reel set; and displaying the generated game outcome including the selected one of the first and second reel sets.

9. The method of claim 8, further comprising the steps of:

determining a first probability associated with the first reel set; and determining a second probability associated with the second reel set; and selecting one of the first reel set and the second reel set based on the determined first and second reel set probabilities.

10. The method of claim 9, further comprising the step of determining the first and second reel set probabilities based on the selected first symbol.

11. A gaming machine, comprising:

a display device configured to display a slot game including a plurality of reels;

accepting, via an acceptor of the gaming machine, physical media indicating a monetary value to establish a credit balance;

allowing a player, via an input device of the gaming machine, to place a wager on a game playable on the gaming machine, the wager being deducted from the credit balance;

a database including a plurality of reel strips, a list of selection probabilities associated with the plurality of reel strips, and a predefined set of symbols, each reel strip of the plurality of reel strips including a plurality of normal symbol positions and a plurality of special symbol positions including at least one group of adjacent special symbol positions, the plurality of reel strips including a first reel strip having a first number of special symbol positions and a second reel strip having a second number of special symbol positions that is different than the first number of special symbol positions, the list of selection probabilities including a set of selection probabilities associated with each symbol of the predefined set of symbols, each set of selection probabilities including a first selection probability associated with the first reel strip and a second selection probability associated with the second reel strip;

and a controller coupled to the display device, the database, and the user input device, the controller for allowing a player to make a wager on the game with the input device, for randomly selecting a first symbol from the predefined set of symbols, determining, from the list of selection probabilities, a corresponding set of selection probabilities associated with the selected first symbol, and randomly selecting one of the first reel strip and the second reel strip as a function of the corresponding set of selection probabilities, the controller for displaying at least one reel of the plurality of reels with the selected reel strip including the first symbol being displayed in each symbol position included in the at least one group of adjacent special symbol positions, and for randomly generating an outcome of the game and spinning and stopping the plurality of reels to display the generated game outcome;

providing by the controller, an award to the player, if any, based on the generated game outcome, the award being added to the credit balance.

12. The gaming machine of claim 11, the controller for:

displaying the game including a plurality of special symbols and a plurality of normal symbols; and selecting the first symbol from the plurality of special symbols.

13. The gaming machine of claim 11, wherein the plurality of special symbol positions includes a first group of adjacent special symbol positions and a second group of special symbol positions.

14. The gaming machine of claim 13, the controller for:

randomly selecting a second symbol;

displaying the first symbol within each of the first group special symbol positions; and displaying the second symbol within each of the second group special symbol positions.

15. The gaming machine of claim 13, wherein the first reel strip including a first number of groups of special symbol positions and the second reel strip including a second number of groups of special symbol positions that is different than the first number of groups.

16. The gaming machine of claim 2, the controller for: randomly selecting one of the first reel strip and the second reel strip for each reel of the plurality of reels.

17. The gaming machine of claim 16, the selection probabilities associated with the first and the second reels strips being different for each of the plurality of reels.

18. The gaming machine of claim 2, the controller for:

displaying the game including a plurality of reel sets, each reel set of the plurality of reel sets including a combination of reel strips including one of the first reel strip and the second reel strip associated with each reel of the plurality of reels;

determining a first reel set including a first combination of reel strips;

determining a second reel set including a second combination of reel strips that is different than the first combination of reel strips;

randomly selecting one of the first reel set and the second reel set; and displaying the generated game outcome including the selected one of the first and second reel sets.

19. The gaming machine of claim 18, the controller for:

determining a first probability associated with the first reel set; and determining a second probability associated with the second reel set; and selecting one of the first reel set and the second reel set based on the determined first and second reel set probabilities.

20. The gaming machine of claim 19, the controller for determining the first and second reel set probabilities based on the selected first symbol.

21. A system, comprising:

a plurality of gaming devices, each gaming device including:

accepting, via an acceptor of the gaming machine, physical media indicating a monetary value to establish a credit balance;

allowing a player, via an input device of the gaming machine, to place a wager on a game playable on the gaming machine, the wager being deducted from the credit balance;

and a display device;

a database including a plurality of reel strips, a list of selection probabilities associated with the plurality of reel strips, and a predefined set of symbols, each reel strip of the plurality of reel strips including a plurality of normal symbol positions and a plurality of special symbol positions including at least one group of adjacent special symbol positions, the plurality of reel strips including a first reel strip having a first number of special symbol positions and a second reel strip having a second number of special symbol positions that is different than the first number of special symbol positions, the list of selection probabilities including a set of selection probabilities associated with each symbol of the predefined set of symbols, each set of selection probabilities including a first selection probability associated with the first reel strip and a second selection probability associated with the second reel strip;

and a system controller coupled to each gaming device of the plurality of gaming devices for displaying a game on at least one gaming device, the game including a plurality of reels, the system controller for allowing a player to make a wager on the game with the input device, for randomly selecting a first symbol from the predefined set of symbols, for determining, from the list of selection probabilities, a corresponding set of selection probabilities associated with the selected first symbol, and for randomly selecting one of the first reel strip and the second reel strip as a function of the corresponding set of selection probabilities, the system controller for displaying at least one reel of the plurality of reels with the selected reel strip including the first symbol being displayed in each symbol position included in the at least one group of adjacent special symbol positions, and for spinning and stopping the plurality of reels to display the generated game outcome;

providing, by the system controller, an award to the player, if any, based on the generated game outcome, the award being added to the credit balance.

22. A system in accordance with claim 21, the system controller for displaying the game including a plurality of special symbols and a plurality of normal symbols and for selecting the first symbol from the plurality of special symbols.

23. A system in accordance with claim 21, wherein the plurality of special symbol positions includes a first group of adjacent special symbol positions and a second group of special symbol positions.

24. A system in accordance with claim 23, the system controller for randomly selecting a second symbol, for displaying the first symbol within each of the first group special symbol positions, and for displaying the second symbol within each of the second group special symbol positions.

25. A system in accordance with claim 23, wherein the first reel strip including a first number of groups of special symbol positions and the second reel strip including a second number of groups of special symbol positions that is different than the first number of groups.

26. A system in accordance with claim 21, the system controller for randomly selecting one of the first reel strip and the second reel strip for each reel of the plurality of reels.

27. A system in accordance with claim 26, the system controller for determining the selection probabilities associated with the first and the second reels strips being different for each of the plurality of reels.

28. A system in accordance with claim 21, the system controller for displaying the game including a plurality of reel sets, each reel set of the plurality of reel sets including a combination of reel strips including one of the first reel strip and the second reel strip associated with each reel of the plurality of reels, for determining a first reel set including a first combination of reel strips, for determining a second reel set including a second combination of reel strips that is different than the first combination of reel strips, for randomly selecting one of the first reel set and the second reel set, and for displaying the generated game outcome including the selected one of the first and second reel sets.

29. A system in accordance with claim 28, the system controller for determining a first probability associated with the first reel set, for determining a second probability associated with the second reel set, and for selecting one of the first reel set and the second reel set based on the determined first and second reel set probabilities.

30. A system in accordance with claim 29, the system controller for determining the first and second reel set probabilities based on the selected first symbol.

* * * * *